US005738007A

United States Patent [19]

Roerig et al.

[11] Patent Number: 5,738,007

[45] Date of Patent: Apr. 14, 1998

[54] HIGH NIP LOAD CALENDER

[75] Inventors: Arnold J. Roerig, Gold Canyon, Ariz.; Dale A. Brown, Milton, Wis.

[73] Assignee: Beloit Technologies, Inc., Wilmington, Del.

[21] Appl. No.: 596,903

[22] Filed: Mar. 12, 1996

[51] Int. Cl.[6] ..... B30B 3/04; D21G 1/00

[52] U.S. Cl. ..... 100/327; 100/162 B; 100/168; 100/176

[58] Field of Search ..... 100/161, 162 R, 100/162 B, 163 R, 163 A, 168–171, 176, 327

[56] References Cited

U.S. PATENT DOCUMENTS

| | | | |
|---|---|---|---|
| 1,593,653 | 7/1926 | Elliott | 100/170 |
| 2,300,994 | 11/1942 | Thiele et al. . | |
| 2,861,504 | 11/1958 | Kane | 100/176 |
| 3,049,074 | 8/1962 | Mellin | 100/168 |
| 3,155,029 | 11/1964 | Thomas . | |
| 3,158,088 | 11/1964 | Seidel . | |
| 3,180,251 | 4/1965 | Tidbury . | |
| 3,270,664 | 9/1966 | Veneman et al. . | |
| 3,451,332 | 6/1969 | Kesler | 100/170 |
| 3,885,283 | 5/1975 | Biondetti . | |
| 4,332,191 | 6/1982 | Kankaanpaa . | |
| 4,670,102 | 6/1987 | Maurer et al. . | |
| 5,038,678 | 8/1991 | Honkala et al. . | |
| 5,127,141 | 7/1992 | Roerig et al. . | |
| 5,144,890 | 9/1992 | Korhonen . | |
| 5,242,361 | 9/1993 | Brown et al. . | |
| 5,329,849 | 7/1994 | Roerig . | |

FOREIGN PATENT DOCUMENTS

| | | |
|---|---|---|
| 808160 | 1/1937 | France . |
| 2321053 | 10/1974 | Germany . |
| 4301096 | 7/1994 | Germany . |
| 2013749 | 8/1979 | United Kingdom . |

OTHER PUBLICATIONS

"More Mills Opt. for the Soft Touch", PPI, Nov., 1992, pp. 61, 63–65.

"New Generation of Supercalenders," Tappi Journal, Jul. 1989, pp. 95–102.

*Primary Examiner*—Stephen F. Gerrity

*Attorney, Agent, or Firm*—Lathrop & Clark

[57] ABSTRACT

A calender employs an open-stack like arrangement with a single vertical beam or support column on each end of the calender. In combination with the support beam, a special swing link is used to support tension loads on the open side of the calender. The nip is thus straddled by structural members between the support column and the link. This combination has the ability to support high linear nip loads, as high as 3,000 PLI or higher. The link has pin connections at both ends so that when one pin is removed, the link can be swung open for roll removal or accessibility. Thus, the strength of the closed-stack calender is combined with the visibility and ease of access of the open-stack calender by the employment of tension links which replace one of the support columns utilized in a closed-stack calender.

22 Claims, 3 Drawing Sheets

HIGH NIP LOAD CALENDER

FIELD OF THE INVENTION

The present invention relates to calenders in general, and to gloss calenders in particular.

BACKGROUND OF THE INVENTION

Calenders are employed in the papermaking industry to improve or modify the surface finish on a paper web. Calenders can also be used to modify the thickness of the paper web or to even out the thickness along or across the web. Calendering is often employed after the web has been completely dried to the nominal range of about five percent moisture. Calenders are also used where some additional residual moisture is left in the web or added by a steam shower or chilled roller. The addition of some moisture to the paper web minimizes the loss of strength which can result from calendering.

A major function of paper calenders is to improve the surface finish of paper which can improve both its appearance and printability. A calender functions by employing pressure to smooth the surface of a paper web as it passes the rolls. One or more of the rolls may be heated.

Supercalenders are comprised of multiple rolls stacked one above the other forming a plurality of nips through which the paper web is passed. Supercalendering is seldom accomplished on-line on the papermaking machine. Supercalenders are usually used in off-machine applications, in combination with rewinders, to improve the surface finish of paper on reels by increasing the length of time the paper web spends transiting a nip by increasing the number of nips. Super calenders have also employed rolls with compliant covers which form nips of increased length, thus increasing the amount of surface improvement which can be accomplished in passing through each of the nips formed by a super calender.

Supercalenders have some drawbacks in that the multiplicity of stacked calender rolls adds to the complexity and cost of a calender. Super calenders also require more time to change calender rolls. Roll change out is often required when the paper grade being processed is changed. Super calenders can present additional problems upon machine startup or when a paper break occurs because of the multiplicity of nips which are required to be threaded.

Papermaking, while involving large measures of science and engineering, remains in part an art. Thus, in repairing, tuning, starting up, or modifying a paper machine, it is often necessary to have the entire machine functioning in order to make adjustments to overcome a particular problem. A paper machine, when properly adjusted, may run for long periods of time with few or no breaks of the web. On the other hand, when a new machine is being brought on line or a major adjustment is being made to an existing machine due to repairs or changeover to different paper grade, the machine may be subject to repeated breaks of the web. Thus, any equipment which facilitates the more rapid threading of papermaking machines has a considerable impact on the amount of time and effort necessary to overcome problems associated with starting up or making a changeover in paper grades.

For many grades of paper, it has been found that the super calender can be replaced by a calender of the gloss type. A gloss calender, or a soft calender, typically employs two rolls forming a single nip, or two pairs of rolls forming two nips, or as many as four pairs of rolls forming four nips. The soft calender has one roll with a compliant cover opposed to a hard surface heated roll. When the soft nip calender is run at high nip loads of up to 3,000 pounds per linear inch (PLI), one or more soft nip calenders can perform the supercalender function with certain grades of paper. Where the soft nip calender can be used, increased economies are achieved by the greater simplicity of the soft nip calender over that of the super calender.

Calenders, including gloss calenders, are generally classified as either open-stack or closed-stack. In a closed-stack calender each side has two substantially parallel support beams. In an open-stack calender, only one support beam at each end of the stack extends vertically and the rolls are cantilevered from this single, vertically extended mounting beam. Because of the high nip loads required for the effective functioning of the soft nip or gloss calender, it has been found necessary to employ the closed-stack design. The closed-stack support system for a calender, however, restricts visibility and accessibility to the calender. Thus a soft calender employing a closed-stack loses some of the advantages of simplicity which are sought in the movement from a super calender to a soft nip calender.

What is needed is a high load soft nip calender of improved visibility and accessibility.

SUMMARY OF THE INVENTION

The calender of this invention employs an open-stack like arrangement with a single vertical beam or support column on each end of the calender. In combination with the support beam, a special swing link is used to support tension loads on the open side of the calender. This is used so the nip is straddled by structural members between the support column and the link. This combination of an open-stack arrangement, together with a tension link which closes the stack, has the advantage of the closed-stack in its ability to support high linear nip loads, as high as 3,000 PLI or higher. The link has pin connections at both ends so the link can be swung open or removed for roll removal or access. Thus, the strength of the closed-stack calender is combined with the visibility and ease of access of the open-stack calender. Employment of the tension links replaces one of the support columns utilized in a closed-stack calender. The rolls employed in the link closed-stack will preferably be self-loading crown control rolls with one of the rolls having position control. However, plain rolls or simple crown control rolls could be used.

To provide rapid opening and closing of the nip between the rolls for ease of threading, the lower roll may be mounted on a pivotal arm which moves the lower roll into operating position with the upper roll by a hydraulic cylinder which causes the arm to rotate. The arm has a stop which becomes engaged when the roll has been moved to the proper position. Another type of mount employs a toggle link which mounts the lower roll. A hydraulic cylinder causes two toggle links to become aligned which in turn positions the roll. Because the toggles move over center when the roll is in its proper position, the toggle link combines two advantageous features: high force engagement and insensitivity to the horizontal position of the cylinder. The insensitivity is the result of the defined angle between the horizontal and the links which governs the vertical extent of the link being very insensitive to small angular changes near 90° to horizontal. Where crown control rolls are used, the upper roll shell is lowered into nipping position by worm driven screw jacks which are linked to the bearing box external housings of the self-loading crown roll. The two jacks on either end of the calender are joined by a cross shaft and are driven by a common drive. In operation, the nip is closed by the action of the internal load shoes in the roll but the rate of travel is governed by the jacks which operate in unison by virtue of the cross shaft, thereby providing uniform nip closing front to back. Once the nip is closed, the jacks are allowed to continue their travel due to the slotted clevis connection between the jacks and the bearing box external housing which permits the jacks to disengage themselves from the roll.

It is a feature of the present invention to provide a calender with a high linear nip load.

It is another feature of the present invention to provide a calender employing a single nip between two rolls in which the nip may be readily opened.

It is a further feature of the present invention to provide a calender with precise and uniform closing of the nip formed between two rolls.

It also a feature of the present invention to provide a calender having improved visibility and accessibility.

It is an additional feature of the present invention to provide a gloss calender having improved threading and ease of roll removal and replacement.

Further objects, features and advantages of the invention will be apparent from the following detailed description when taken in conjunction with the accompanying drawings.

DESCRIPTION OF THE PREFERRED EMBODIMENTS

Figure 1:
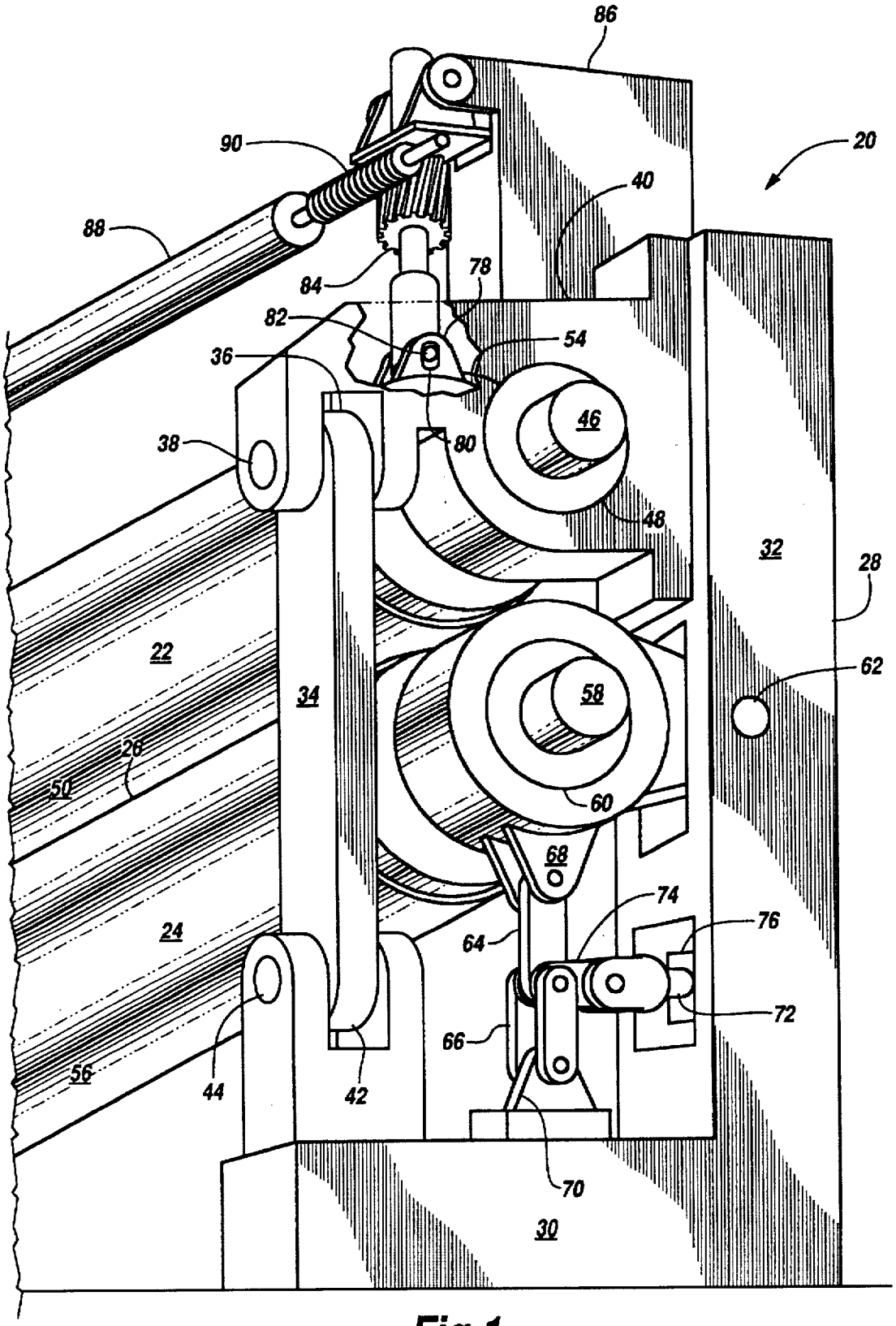
FIG. 1 is a fragmentary isometric view of the calender of this invention.

Referring more particularly to FIGS. 1–6, wherein like numbers refer to similar parts, a gloss calender 20 is shown in FIG. 1. A gloss calender is a type of calender having very few rolls, generally two or four rolls. The gloss calender 20 has an upper roll 22 and a lower roll 24 which form a nip 26. A paper web (not shown) is passed through the nip 26 to improve the surface finish of the paper. The gloss calender 20 can perform the smoothing function of a supercalender with relatively few calendering rolls. The gloss calender 20 typically employs a compliant roll and a metal roll. The metal roll is heated. The maximum temperature of the metal roll is governed by the allowable temperature in the elastic or compliant material coating the opposed roll. The metal roll is actually heated to a temperature greater than that which can be withstood by the compliant roll surface with the web of paper between the heated roll and compliant roll preventing the compliant surface from overheating. In the event of a paper break, the nip formed between the compliant and the metal roll must be capable of being rapidly opened in order to prevent damage to the compliant surface of the compliant roll.

The gloss calender 20 shown in FIG. 1 has a frame which includes two L-shaped supports 28, one on either end of the rolls 22, 24. The supports 28 on either end of the rolls have similar mechanisms for supporting the rolls, and the discussion below applies to both supports 28. The support 28 has a base portion 30 and a vertical member 32. In order to perform the function of a supercalender, the nip 26 of the gloss calender 20 is usually relatively highly loaded, in the neighborhood of twenty-five hundred to three thousand pounds per linear inch. This high nip load requires a high strength structure to contain the high separation forces between the rolls 22, 24. This has typically led to the use of massive side frames which enclose the roll ends but which also restrict visibility and accessibility to the rolls.

Calenders which employ side frames enclosing the roll ends are generally described as closed stack calenders. In an open stack calender the rolls are mounted in a cantilever fashion to a single vertical support at each end, giving unrestricted visibility and accessibility to the rolls. However, insufficient strength in the roll supports may prevent development of the high nip loads required in a gloss calender.

The solution employed by the gloss calender 20 is to close the support 28 with a tension link 34. The upper end 36 of the link 34 is mounted by a pin 38 to a cantilever mount 40 which supports the upper roll 22 on the vertical support member 32. The lower end of the link 42 is joined by a pin 44 to the base portion 30 of the calender support 28. The link 34, because it supports tension loads alone, may be relatively lightweight and can easily be removed to gain access to and to remove the upper and lower rolls 22, 24. The gloss calender 20 employs self-loading control deflection rolls. The upper roll 22 has a non-rotating support beam 46 which is mounted in a deflection bearing 48 which is part of the cantilevered mount 40.

The shell 50 of the roll 22 is mounted to a non-rotating bearing box 54, one of which is shown in FIG. 1. The shell 50 is supported on the support beam 46 by one or more hydraulic pistons (not shown) which are positioned to move the shell 50 towards the nip 26. For examples of how the shell 50 is mounted to the support beam 46, see our earlier U.S. Pat. No. 5,242,361, which is incorporated herein by reference.

The lower roll 24 is also a self-loading crown deflection roll and has a shell 56 and a non-rotating support beam 58 which is mounted in a bearing member or flex bearing 60 similar to the cantilever mount 40. The flex bearing 60 is mounted by a pivot 62 to the vertical support member 32.

The lower roll 24 may employ a position control system such as set forth in U.S. Pat. No. 5,447,605 to Roerig, which is incorporated herein by reference. The use of position control in combination with a self-loading crown control roll for the upper roll 22 and the lower roll 24 facilitates a high uniform nip load between the opposed rolls. Typically one of the rolls 22, 24 is a compliant roll and one is a heated metal roll. The compliant roll assures that the paper will not be over compressed. Over compression tends to cause a greasy or mottled pattern on the paper web being processed. At the same time, the high temperature of the metal roll renders the outer layer of the paper web more pliable so the surface finish may be improved by the nip 26. If the paper web is not prewrapped onto the heated metal roll, temperature gradient calendering will be accomplished wherein the heating does not have sufficient time to fully penetrate into the paper web with the result that surface finish improves while paper caliper or thickness remains substantially undiminished.

Because effectiveness of gloss calenders is limited by the maximum temperature which the compliant surface of the compliant roll can withstand, in the event of a paper break it is necessary to separate the rolls 22, 24 rapidly in order to prevent damage of the compliant surface.

To bring about the rapid separation of the lower roll 24 from the upper roll 22 on the occurrence of a paper break, and to thus avoid damaging the compliant roll by overheating it in contact with the metal roll, the gloss calender 20 employs lower roll linkages which have an upper link 64 joined to a lower link 66. The upper link is pivotally mounted by mounting ears 68 to the flex bearing 60. The lower link is pivotally mounted by a base mount 70 to the base portion 30 of the L-shaped support 28. A piston arm 72 is pivotally mounted to both links at a tang 74 between the upper and lower links 64, 66. When the piston arm 72 is retracted by a piston 76, the lower roll and its flex bearing 60 are pivoted about the pivot mount 62 to thereby open the nip 26. Because the upper link 64 and the lower link 66 form cams which move over center when the nip 26 is closed, a mechanical advantage is developed by the links 64, 66.

The hydraulic pistons (not shown) in each of the crown control rolls 22, 24 are positioned between the support beams 46, 58 and the roll shells 50, 56. When hydraulic pressure is released in the lower roll 24 the shell 56 is moved by gravity away from the nip. On the other hand, with the upper roll 22, the shell 50 must be supported because gravity will tend to move the shell towards the nip 26 even when the hydraulic pistons are not exerting a load on the shell. If the upper shell 50 is not supported when the lower roll 24 is swung away, it will move downwardly under the force of gravity to remain in contact with the lower roll 24.

The upper shell 50 is thus supported by a bracket 78 on the bearing box 54 to which the shell 50 is rotatably mounted. For an example of how the shell 50 is mounted to the bearing box 54 see our earlier U.S. Pat. No. 5,242,361. The bracket 78 has a clevis slot 80 in which is mounted a clevis pin 82 which can move vertically within the slot 80. The clevis pin 82 is mounted to a screw jack 84. A means for lowering the upper roll shell is provided by an arrangement which includes the screw jacks 84 mounted at each end of the calender 20 to an extension 86 which is connected to the vertical support member 32. The two screw jacks 84 are driven in tandem by a cross shaft 88 which is driven by a drive (not shown). The cross shaft has a worm gear 90 which drives the screw jacks 84 on each end of the calender 20 so the screw jacks 84 act in tandem to raise and lower the shell 50 of the upper roll 22 maintaining the shell at all times parallel to the lower roll 24. In operation, the nip 26 between the rolls 22, 24 is closed by the action of the internal load shoes (not shown) which are disposed between the shell 50 and the support beam 46. But the rate of travel of the shell 50 towards the nip 26 is governed by the jacks 84 which operate in unison by virtue of the cross shaft 88. Once the nip 26 is closed, the jacks 88 are allowed to continue their travel which, due to the slotted clevises 80 and the clevis pins 82 which link the clevises to the screw jacks 84, disengage the screw jacks from supporting engagement with the bearing box 54, thus disengaging the jacks from supporting the upper roll 22.

Figure 3:
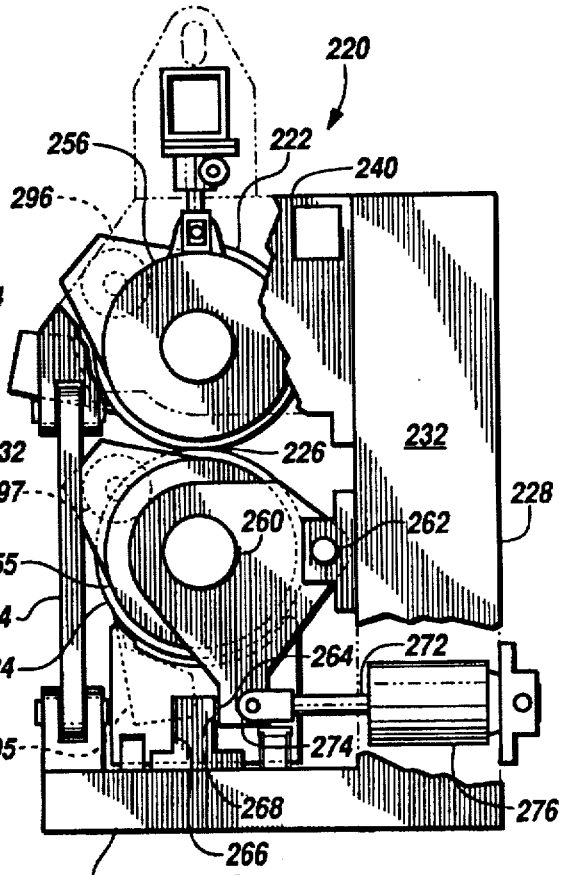
FIG. 3 is a side elevational view, partly cut away, of the calender of FIG. 2
Figure 5:
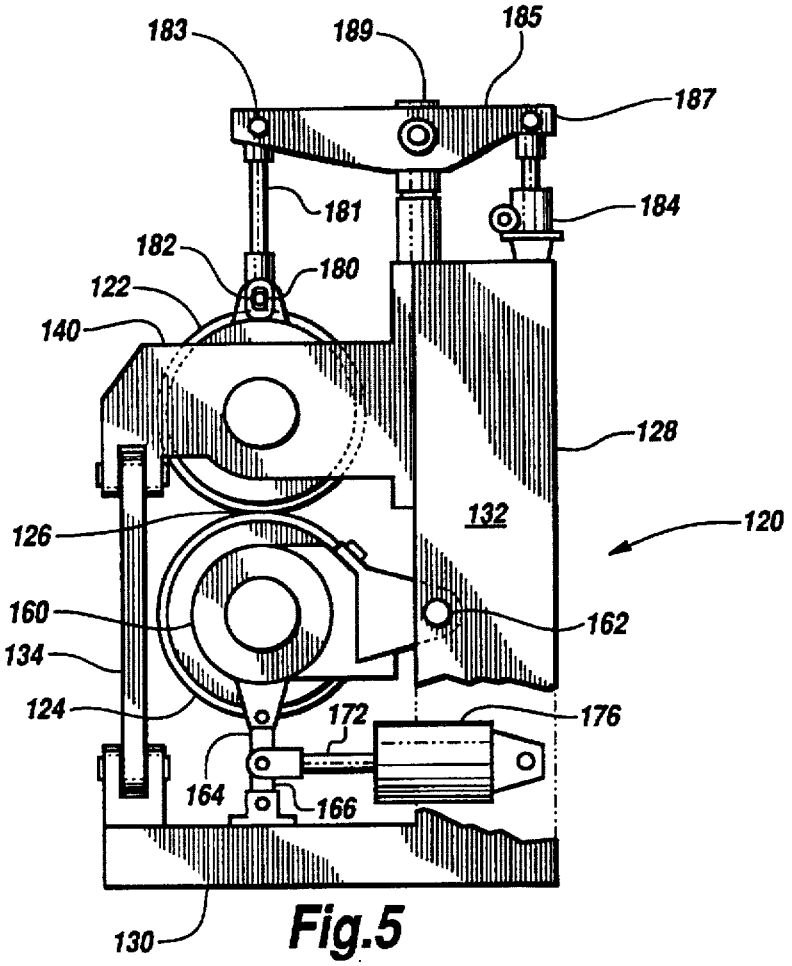
FIG. 5 is a side elevational view of another alternative embodiment of the calender of this invention.
Figure 6:
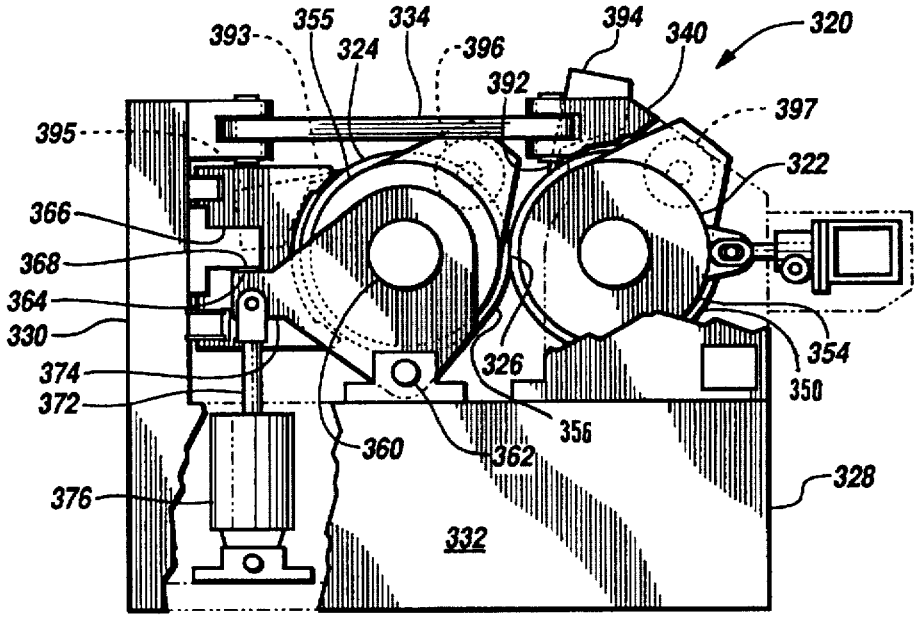
FIG. 6 is an alternative embodiment of the calender of FIG. 3 in which the calender rolls are horizontally disposed.

The hydraulic cylinders 76 of FIG. 1, 176 of FIG. 5, 276 of FIG. 3 and 376 of FIG. 6 are used for quick nip opening regardless of roll type. When the top roll is a self-loading crown control roll, precise nip closing can be provided as shown in FIG. 1.

An alternative embodiment gloss calender 120 of this invention is shown in FIG. 5. The calender 120 has an upper roll 122 and a lower roll 124 which form a nip 126. The upper and lower rolls are mounted on an L-shaped support 128 which has a horizontal base portion 130 and a vertical support member 132. A tension link 134 extends between a cantilever mount 140 and the base portion 130. The lower roll 124 has a flex bearing 160 which mounts to a pivot 162 on the vertical support member 132. A hydraulic cylinder 176 is joined to upper links 164 and lower links 166 so the motion of the piston arm 172 causes the lower roll 124 to pivot about the pivot 162 to open the nip 126 between the upper roll 122 and the lower roll 124.

The gloss calender 120 differs from the gloss calender 20 of FIG. 1 principally in that the clevis pin 182 in the clevis slot 180 is connected by means of a support rod 181 to a first end 183 of a lever arm 185. The second end 187 of the lever arm 185 is mounted to the screw jack 184. The lever arm 185 is pivotally mounted to a fulcrum support 189. This arrangement moves the screw jacks 184 away from directly above the upper roll 122 thus improving the access to the roll 122, and facilitating its removal by a crane. The lever arm 185 also provides for greater motion of the clevis pin 182 for a given amount of motion in the screw jack 184.

Figure 4:
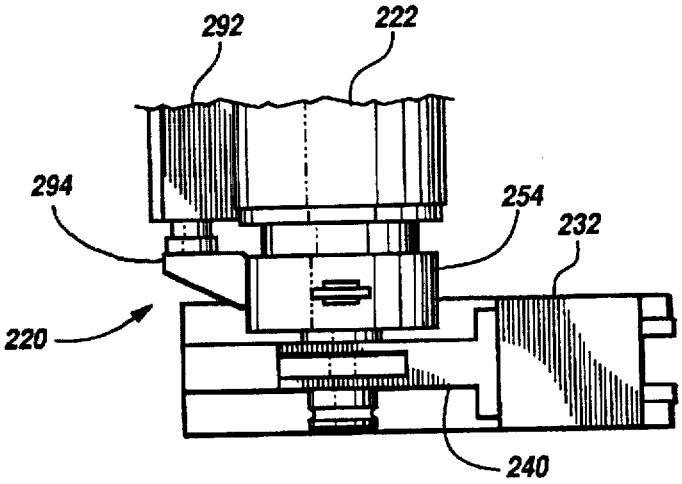
FIG. 4 is a fragmentary top plan view of the calender of FIG. 2.
Figure 2:
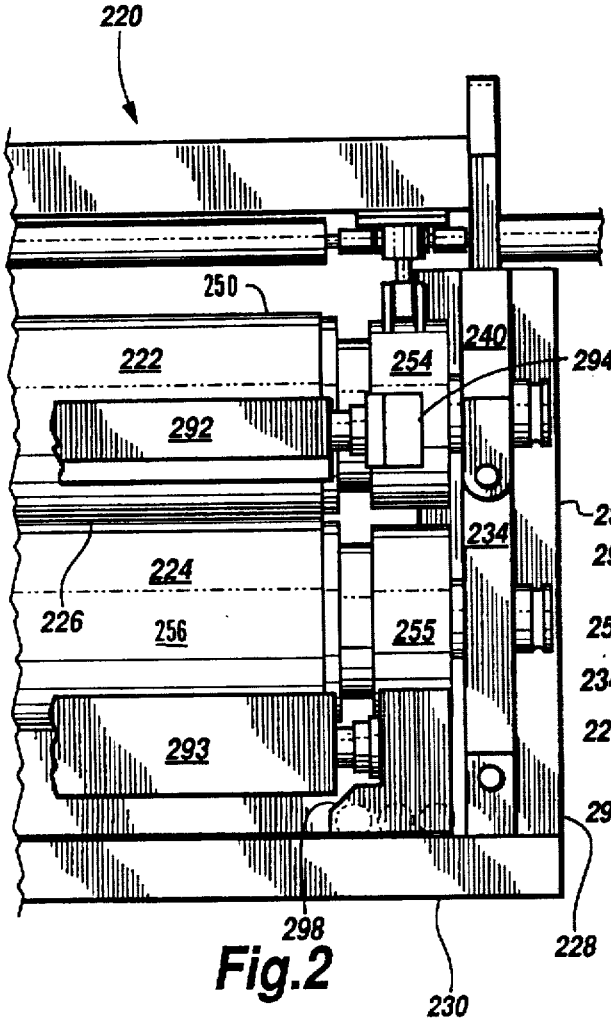
FIG. 2 is a fragmentary front elevational view of an alternative embodiment of the calender of this invention.

Another alternative embodiment gloss calender 220 of this invention is shown in FIGS. 2, 3 and 4, which is similar in some respects to the gloss calenders 120 in FIG. 5 and 20 in FIG. 1. The gloss calender 220 has an upper roll 222 and a lower roll 224 which form a nip 226. The rolls 222, 224 are supported on an L-shaped support 228 which has a base portion 230 and a vertical support member 232. A tension link 234 extends between a cantilever mount 240 which holds the upper roll and a base portion 230 of the L-shaped support. The gloss calender 220 does not employ a link mechanism for moving the lower roll, such as the one shown in FIG. 1, but instead uses a hydraulic cylinder 276 which moves a piston arm 272 which is pivotally mounted to the flex bearing 260. The flex bearing is in turn pivotally mounted to a pivot 262 on the vertical support 232. The piston arm 272 is mounted to a pivot extension 274 which has a portion defining a positioning surface 264 which moves against a stop 266 which has a stop engagement surface 268. In this arrangement for opening and closing the nip 226, the lower roll 224 may be precisely positioned by positioning one or more shims to adjust the position of the stop engagement surface 268.

Also as shown in FIGS. 2–4, the calender 220 has upper doctor blades 292 and upper doctor blade mounts 294 which are mounted to the upper bearing box 254. Similarly, lower doctor blades 293 are mounted to lower doctor mounts 295 which are connect to lower bearing box housings 255. Doctor blades prevent the build up of fibers on the roll surfaces and, in the event of a paper break, prevent the paper web from wrapping around the roll.

Upper gear drives 296 and lower gear drives 297, shown in FIG. 3, drive the outer shells 250, 256 of the gloss calender 220. In operation, the link 234, shown in FIG. 2 and 3 gives the calender 220 the strength of the closed stack calender. Yet by removing the link 234, access is allowed to the calender supports 228 for the removal of the upper and lower rolls 222, 224.

A removal cart 298 for the bottom roll 224 is shown in FIG. 2. The removal cart 298 is designed to fit around the roll doctor mount 295 and can remain in place while the calender 220 is in operation. To remove the lower roll 224, the swing link 234 is opened, the stop 266 is removed and the roll is lowered onto the cart 298. Another option (not shown) is to use a partial removal cart to support only one side of the roll and use a crane on the other. The doctor blades on the doctor mounts are mounted directly to the roll bearing box housings 254, 255, and thus move with the rolls with the opening and closing of the nip.

An alternative embodiment gloss calender 320, shown in FIG. 6, is similar to the gloss calenders 220 in FIG. 3 but has rolls which are disposed in a horizontal plane. The gloss calender 320 has a non-pivoting roll 322, which engages against a pivotable roll 324 to form a nip 326. The rolls 322, 324 are supported on an L-shaped support 328 which in this embodiment has base portion 330 positioned vertically and a support member 332 positioned horizontally. A tension link 334 extends between the mount 340 which holds the roll 322, and the vertical base portion 330 of the support member 332. The gloss calender 320 uses a hydraulic cylinder 376 which moves a piston arm 372 which is pivotally mounted to the flex bearing 360. The flex bearing 360 is in turn pivotally mounted to a pivot 362 on the support member 332. The piston arm 372 is mounted to a pivot extension 374 which has a portion defining a positioning surface 364 which moves against a stop 366 which has a stop engagement surface 368. This arrangement for opening and closing the nip 326 has the advantage that the pivoting roll 324 may be precisely positioned by shimming the stop engagement surface 368.

A first doctor blade 392 in a first doctor blade mount 394 is connected to the first bearing box 354. Similarly, a second doctor blade 393 is mounted to a second doctor mount 395 which is connected to second bearing box housings 355.

Gear drives 396, 397 drive the outer shells 350, 356 of the gloss calender 320. The link 334 gives the calender 320 the strength of the closed stack calender. Yet removal of the link 334 allows crane access to the calender support 328 for the removal of the rolls 322, 324.

In general, the first and second rolls of the gloss calender may be oriented in any plane with a mounting face on one side of the rolls with the rolls cantilevered from that face together with a removable swing link which encloses the rolls providing the strength of a closed stack arrangement with the accessibility both visually and physically of the open stack arrangement.

It should be understood that one conventional crowned rolls may be employed with the gloss calenders 20, 120, 220 and 320, described herein. At the same time one or more crown control rolls could be employed. If two self-loading crown control rolls are employed, a position control roll, such as illustrated and described in U.S. Pat. No. 5,447,605 to Roerig, should be employed.

It should be understood that where hydraulic or screw jack type actuators are shown, actuators of various types known to those skilled in the art could be employed.

It should also be understood that although the link is shown pinned, other mechanical linking means such as collets, bolts, wedges or hooks could be employed.

It is understood that the invention is not limited to the particular construction and arrangement of parts herein illustrated and described, but embraces such modified forms thereof as come within the scope of the following claims.

We claim:

1. A gloss calender, comprising:

a first roll, wherein the first roll comprises a shell rotatably mounted to a bearing box;

a second roll forming a nip with the first roll;

two spaced apart supports forming an open stack mount for the first and second rolls, the supports having a first side, wherein the first roll and the second roll extend between the two supports and are mounted to the first sides of the supports;

a link removably mounted to each of the supports, wherein the links extend across the nip in spaced relation to the first side such that the first roll and the second roll are positioned between the links and the supports, and wherein the links support tension loads produced by the nip loading between the first roll and the second roll;

a bracket extending from the bearing box;

portions of the bracket which define a vertically extending clevis slot;

a clevis pin which extends through the clevis slot and which is moveable vertically within the clevis slot; and a screw jack mounted to the support, wherein the clevis pin is engaged with the screw jack, such that rotation of the screw jack elevates the bearing box and the attached shell to thereby support the shell when not in engagement with the second roll, and wherein the clevis pin may be driven downward in the clevis slot so the screw jack is in non-supporting relation to the bearing box when the first roll is engaged with the second roll.

2. The calender of claim 1 wherein a screw jack is mounted to each end of the calender, and a cross shaft extends between the two screw jacks to drive both screw jacks in tandem.

3. A calender for a paper web comprising:

a frame having a first support and a second support, wherein each support has a base, a support member which extends upwardly from the base, and a cantilever mount which extends outwardly from the support member above the base;

a first roll rotatably mounted to the frame between the cantilever mounts of the first support and the second support;

a bearing member pivotably mounted to each support member;

a second roll rotatably mounted to the bearing members, wherein the second roll is positioned beneath the first roll, and wherein the bearing members are pivotable to bring the second roll into engagement with the first roll to define a nip therebetween; and a link releasably connected between the cantilever mount and the base of each support, wherein each link extends across the nip and is spaced from the two rolls, and wherein the links support tension loads produced by loading the nip, and wherein the links are removable from the frame to allow access to the first roll and the second roll.

4. The calender of claim 3 further comprising an actuator extending between a support and a bearing member, wherein movement of the actuator causes the second roll to move with respect to the first roll.

5. The calender of claim 4 further comprising:

a first link connected to a bearing member; and a second link connected to support member base, and connected to the first link, wherein the actuator is connected to the first and second links, and wherein movement of the actuator drives the links to move the second roll into and out of engagement with the first roll.

6. The calender of claim 4 further comprising:

a stop extending from a support base beneath the second roll; and a stop engagement surface defined by portions of a bearing member, wherein the actuator is pivotably connected to the bearing member to drive the second roll into engagement with the first roll and the stop engagement surface into engagement with the stop.

7. The calender of claim 6 further comprising at least one shim which engages the stop engagement surface to thereby allow precise positioning of the second roll in engagement with the stop engagement surface.

8. The calender of claim 3 further comprising a removal cart positioned between the supports beneath the second roll, wherein the removal cart does not interfere with the second roll when the calender is in operation, and wherein the removal cart has portions which engage the second roll when it is lowered away from the first roll, to thereby permit the removal of the second roll from the calender.

9. The calender of claim 3 further comprising:

a lever arm pivotably mounted to each support above the cantilever mounts, wherein the lever arm has a first end which is connected by a support rod to support an end of the first roll, and a second end spaced from the first end;

an actuator which extends between the lever arm second end and the frame, whereby actuation of the actuator tilts the lever arm for vertical displacement of the connected first roll.

10. The calender of claim 3 wherein the first roll comprises a shell rotatably supported at its ends, and further comprising means for lowering the first roll shell to bring it closer to the second roll.

11. The calender of claim 3 wherein the first roll comprises a shell rotatably mounted to a bearing box, and further comprising:

a bracket extending from the bearing box;

portions of the bracket which define a vertically extending clevis slot;

a clevis pin which extends through the clevis slot and which is moveable vertically within the clevis slot; and a screw jack mounted to the support, wherein the clevis pin is engaged with the screw jack, such that rotation of the screw jack elevates the bearing box and the attached shell to thereby support the shell when not in engagement with the second roll, and wherein the clevis pin may be driven downward in the clevis slot so the screw jack is in non-supporting relation to the bearing box when the first roll is engaged with the second roll.

12. The calender of claim 11 wherein a screw jack is mounted to each end of the calender, and a cross shaft extends between the two screw jacks to drive both screw jacks in tandem.

13. A calender for a paper web comprising:

a first support, the support having a base and a leg extending from the base;

a second support positioned in spaced parallel relation to said first support, the second support having a second base and a second leg extending therefrom, the first leg and the second leg having first leg portions and second leg portions from which first and second cantilever roll supports extend spaced from and overlying said first and second bases;

a first roll mounted between said first and second cantilever supports between said first and second mounts;

a second roll pivotally mounted at a first end to the first leg and at a second end to the second leg and thus extending between said first and second supports, said second roll being mounted between the first and second bases and the first and second cantilever supports;

a portion of the first cantilever support distal from the first leg;

a portion of the second cantilever support distal from the second leg;

a first link removably mounted to the distal portion of the first cantilever support and the first base, wherein the first end of the second roll is spaced between the first link and the first leg and between the first base and the first cantilever mount; and a second link removably mounted between the distal portion of the second cantilever support and the second base, wherein the second end of the second roll is spaced between the second leg and the second link and further spaced between the second cantilever support and the second base.

14. The calender of claim 13 further comprising:

a first cam mechanism which extends between the first base and the first end of the second roll; and a second cam mechanism which extends between the second base and the second end of the second roll, wherein the first cam mechanism and the second cam mechanism are moveable to advance the second roll toward and away from the first roll to facilitate rapid threading of the calender.

15. The calender of claim 14 wherein each of the first cam mechanism and the second cam mechanism comprises:

a first link connected to the second roll;

a second link connected to a base, and connected to the first link; and a linear actuator extending from a support leg which is connected to the first and second links, wherein movement of the linear actuator moves the second roll into and out of engagement with the first roll.

16. The calender of claim 13 wherein the first roll is a self-loading crown control roll.

17. The calender of claim 13 wherein the first roll and the second roll are self-loading crown control rolls and wherein at least one of said first roll and said second roll employs position control.

18. The calender of claim 13 wherein at least one of said first roll and said second roll has a compliant surface.

19. The calender of claim 13 wherein one of said first and second rolls has a non-compliant surface.

20. The calender of claim 13 wherein one of said first roll and said second roll has a compliant surface and the other of said first roll and said second roll has a non-compliant surface.

21. The calender of claim 20 wherein said roll having a non-compliant surface is heated.

22. The calendar of claim 13, wherein:

the first and second rolls each have an axis of rotation, and the rolls are so arranged that their axis of rotation are disposed in a plane, which plane can be oriented at any position between, and including, horizontal and vertical.

* * * * *